US006052094A

United States Patent [19]

Kharadly et al.

[11] Patent Number: 6,052,094

[45] Date of Patent: Apr. 18, 2000

[54] ANTENNA SYSTEM FOR MILLIMETER WAVE LENGTH COMMUNICATION SYSTEMS

[76] Inventors: Mostafa Z. Kharadly, 1766 West 45th Avenue, Vancouver, British Columbia, Canada, V6P 2W1; Amiee Y. Chan, 166 West 45th Avenue, Vancouver, British Columbia, Canada, V5Y 2W1

[21] Appl. No.: 09/035,879

[22] Filed: Mar. 6, 1998

[51] Int. Cl.[7] ..... H01B 1/42

[52] U.S. Cl. ..... 343/770; 343/700 MS

[58] Field of Search ..... 343/770, 704, 343/789, 824, 882, DIG. 1, 880

[56] References Cited

U.S. PATENT DOCUMENTS

| | | | |
|---|---|---|---|
| 3,440,659 | 4/1969 | Kreitzberg | 343/882 |
| 3,918,065 | 11/1975 | Hutchison et al. | 343/872 |
| 5,440,318 | 8/1995 | Butland et al. | 343/814 |
| 5,600,337 | 2/1997 | Cassel | 343/770 |
| 5,724,042 | 3/1998 | Komatsu et al. | 342/175 |

OTHER PUBLICATIONS

"Wet Antenna Effect on VSAT Rain Margin" Cheah: IEEE Transactions on Communications vol. 41, No. 8, Aug. 1995.

*Primary Examiner*—Don Wong
*Assistant Examiner*—James Clinger
*Attorney, Agent, or Firm*—C. A. Rowley

[57] ABSTRACT

The effect of rain wetting a planar array antenna is reduced substantially by mounting the antenna with its radiating face facing downwards on an angle α of about 30–80° to the horizontal and adjusting the angle θ of the main beam of the planar array antenna to its radiating face so that the angle θ of the main beam to the radiating face of the antenna and the angle α of the radiating face to the horizontal combine to direct the main beam at the elevation angle ω toward a selected target.

2 Claims, 3 Drawing Sheets mean(wet) = -11.138 stdev(wet) = 1.59
mean(dry) = -0.467 stdev(dry) = 0.572 mean(wet2) = -0.318 stdev(wet2) = 0.4
mean(dry2) = -0.128 stdev(dry2) = 0.751

ANTENNA SYSTEM FOR MILLIMETER WAVE LENGTH COMMUNICATION SYSTEMS

FIELD OF INVENTION

The present invention relates to antennas, more particularly the present invention relates to a system for minimizing the effect of rain wetting the radiating surface of a planar array antenna.

BACKGROUND OF THE INVENTION

The term "planar array antenna" used in this application is intended to include resonant and non-resonant slotted arrays excited by a wave guide or micro-strip network and Micro-strip antennas normally formed by micro-strip patches, stubs or dipoles etched in the surface of a metal cladded dielectric substrate. Micro-strip antennas are usually fed via a micro-strip but wave guides or coaxial feeds may also be used. The term "planar array antenna" further includes dielectric resonant antennas excited either by a micro-strip or wave guide network.

The problem of rain wetting antenna particularly planar array antennas used for short wave length transmissions, i.e. transmissions with wavelengths in the millimeter range are well recognized. Water or condensate present on the radiating face of planar array antenna interferes with reception or transmission of these short waves and thereby necessitates the use of much more sophisticated electronics to obtain a meaningful signal from the distorted signal available from the wet antenna. This wetting phenomenon significantly increases the capital and operating cost of these planar array antennas.

A paper by Cheah entitled "Wet Antenna Effect on VSAT Rain Margin" in IEEE Transactions on Communications, Vol. 41, No. 8, August 1993 has described wet antenna effect on VSAT (very small aperture terminal).

BRIEF DESCRIPTION OF THE PRESENT INVENTION

It is an object of the present invention to provide a planar array antenna system wherein the effect of rain wetting the radiating surface of the planar array antenna is significantly reduced.

Broadly, the present invention relates to a method of reducing the effect of rain wetting a radiating face of a planar array antenna for millimeter wave length communication systems, said planar array antenna for said millimeter wave length communication system being selected from the group consisting of planar array antenna constructed to operate at either at single frequency or at a pair of different frequencies comprising mounting said planar array antenna with its radiating face at an angle $\alpha$ to the horizontal of between 20 and 70° and with its radiating face facing downwards, selecting a radiating angle $\theta$ for a main beam of said planar array antenna coordinated with said angle $\alpha$ to the horizontal to focus said main beam in a selected direction at an elevation angle $\omega$ toward a selected target.

Preferably said planar array antenna is a slotted array antenna.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
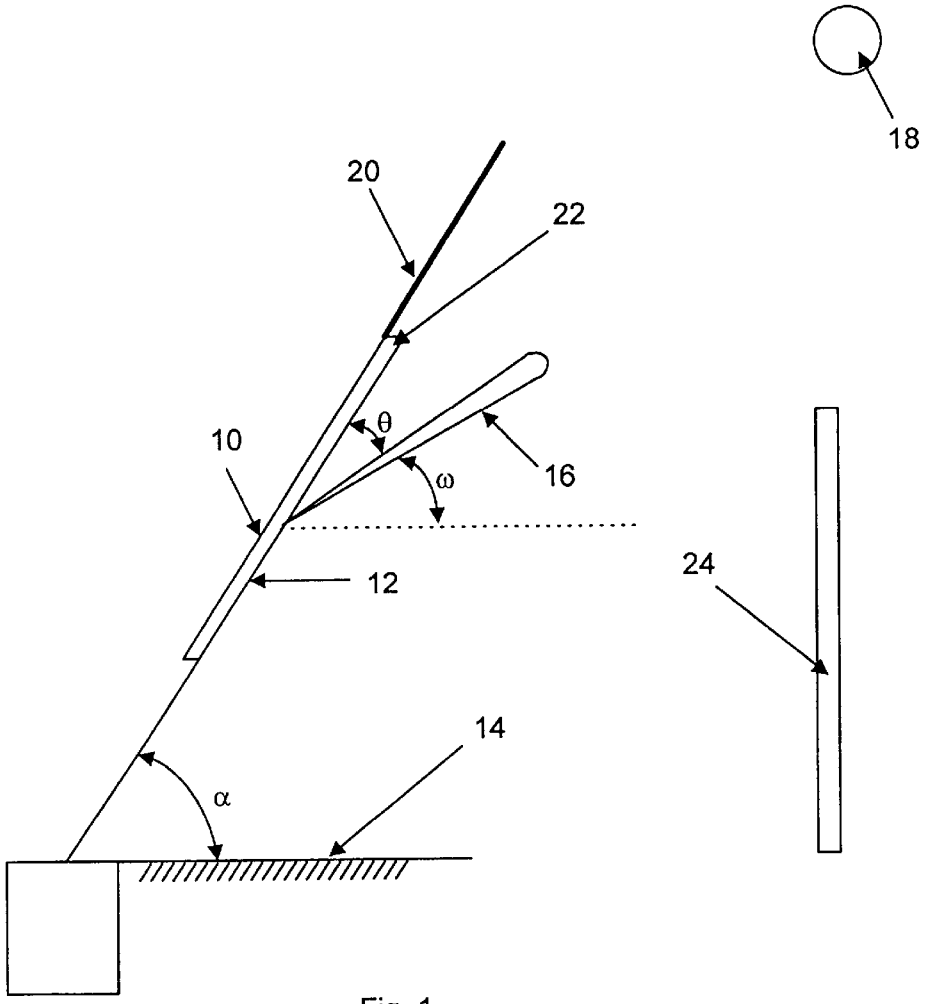
FIG. 1 is a schematic representation of an antenna oriented to minimize wetting interference.

As shown in FIG. 1, the antenna 10 is mounted by a suitable means not shown with its radiating face 12 at an angle $\alpha$ to the horizontal as represented by the plane 14. This angle $\alpha$ will generally be between about 20 and 70° to the horizontal.

The radiation angle $\theta$, i.e. the angle between the radiating face 12 and the axis of the main beam 16 is designed, by known methods, to direct the main beam 16 at a selected target 18 such as a satellite that is at a known elevation or look angle $\omega$ to the horizontal.

The angle $\omega$ is known based on the position of the satellite or other target 18.

The angle $\alpha$ of the radiating surface of the antenna to the horizontal is set based on the optimum to protect the radiating surface from rain while still permitting the beam to be accurately aimed at the satellite or target 18 without impairing significantly the power of the main beam 16. The radiating angle $\theta$ of the main beam 16 to the radiating face 12 is then set equal to the difference between the elevation angle c and the angle $\alpha$ of the radiating face 12 to the horizontal to thereby aim or focus of the main beam 16 toward the satellite or the like 18.

If desired, a suitable umbrella like structure as indicated at 20 may be made to project beyond the free end 22 of the antenna 10 to help shield the radiating face 12 from rain. Also, if desired, a barrier 24 may be positioned spaced from the radiating face 12 in a position to further protect the radiating surface 12 from rain without interfering with the trajectory of the main beam 16 from the antenna 10 to the target 18.

It is also possible to wrap the antenna in a suitable plastic wrapping (not shown) to help to prevent water from penetrating the antenna structure.

EXAMPLE

An antenna was set up as a receiving antenna with its main beam angle $\theta$ set at 32° to the plane of the radiating apertures. The antenna was wrapped in a thin plastic sheet to prevent moisture from entering the antenna system.

A continuous wave source with a centre frequency of operation was 39.5 GHz provided incident radiation at 32° to the horizontal on the antenna at a power level that was randomly variable with time within ±1 dB.

The antenna was tested in two different mounting configurations a) Horizontal—with the radiation apertures facing upward, and b) Inverted—with the radiating face at an angle $\alpha$ to the horizontal of 64° and facing downwards.

It will be apparent that in both cases a) and b) the look or elevation angle $\omega$ was the same i.e. 32° or 64−32=32°.

Water was rained down on the antenna from 4 shower heads to simulate rain. The shower permitted varying the intensity and drop size of the simulated rain.

Figure 2:
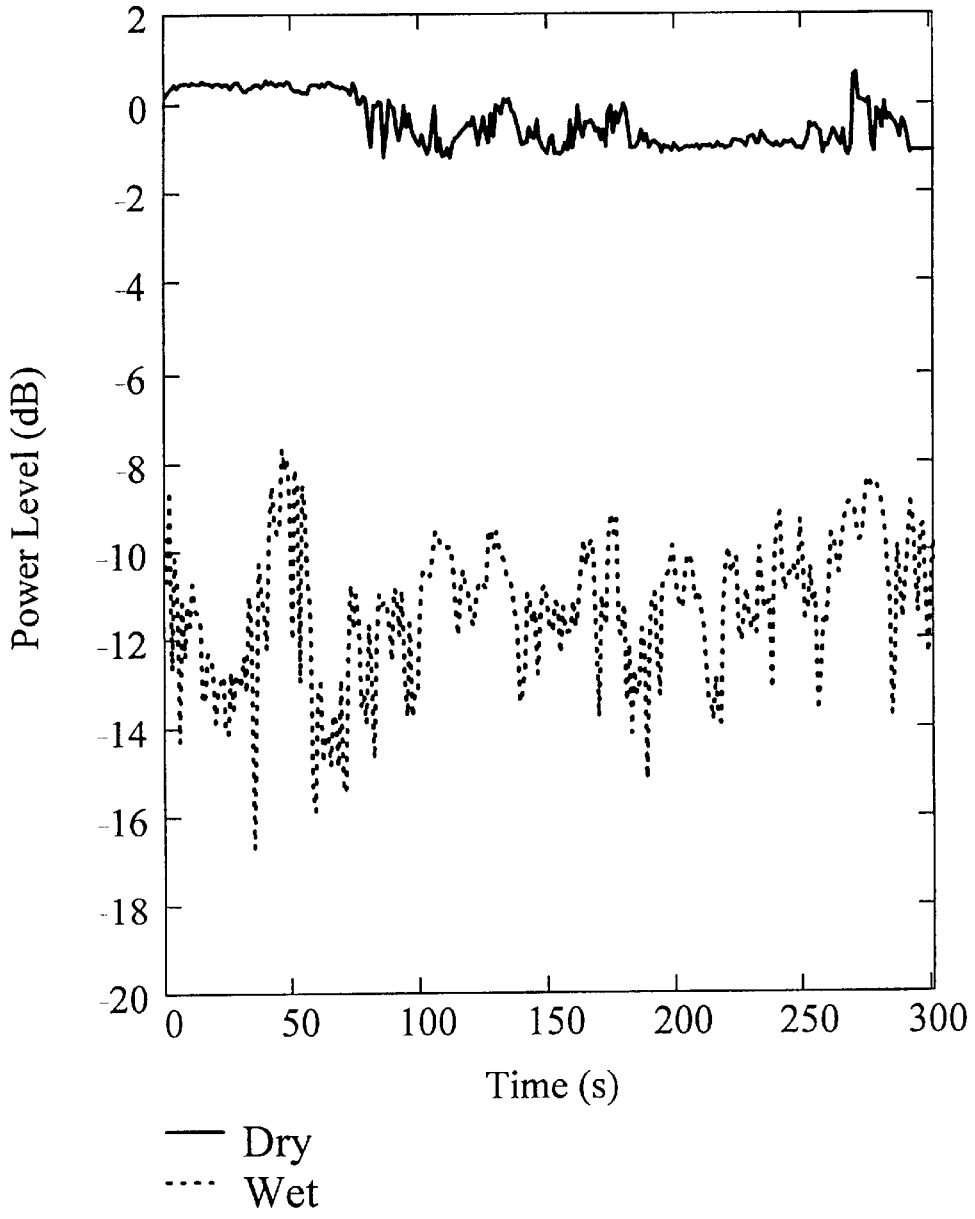
FIG. 2 shows the power levels versus time of a conventionally mounted planar array antenna under wet and dry conditions of operation.
Figure 3:
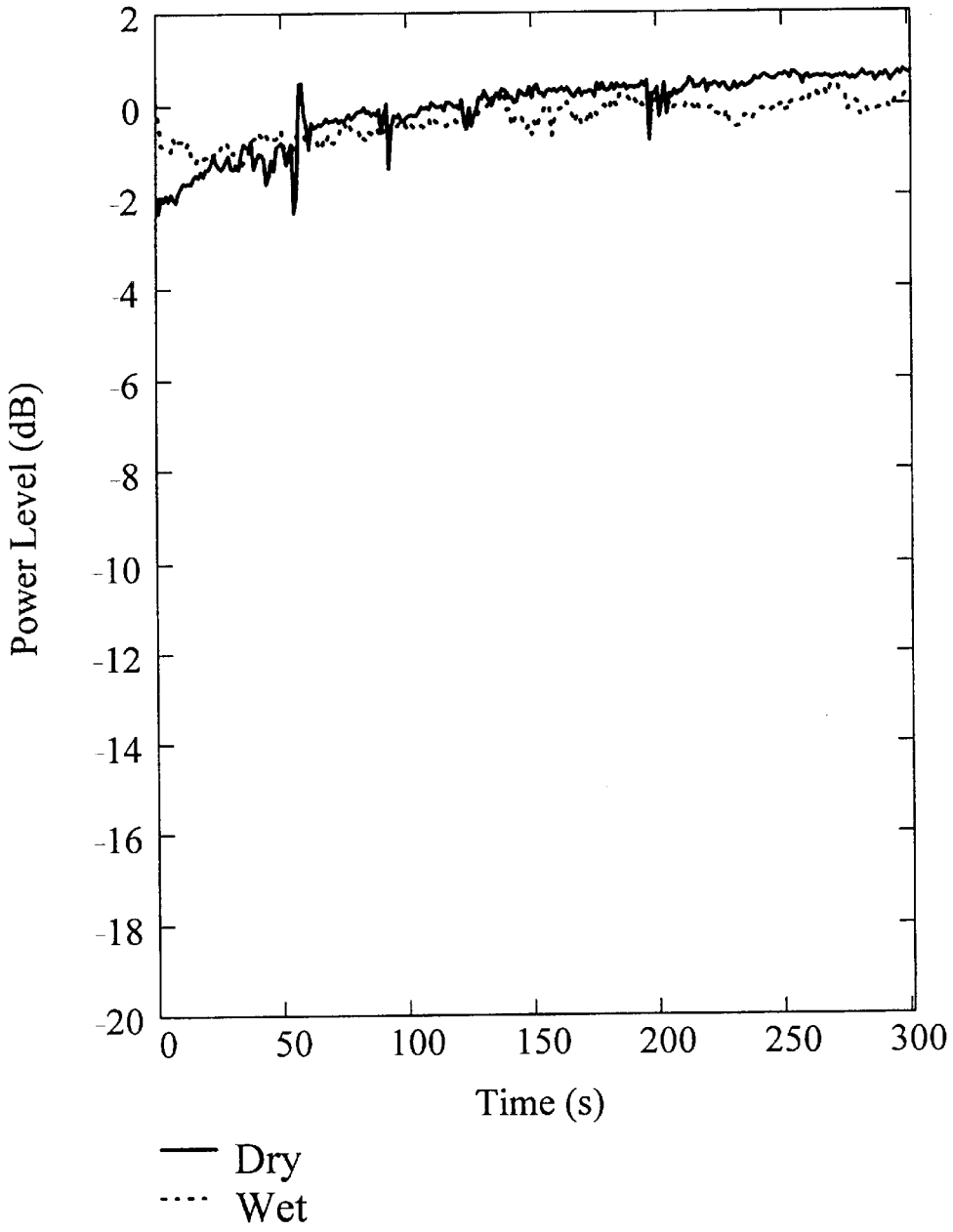
FIG. 3 is a plot similar to FIG. 2 showing the power level versus time for dry and wet conditions for inverted antenna mounted in accordance with the present invention.

The received power level of the antenna was monitored with and without the application of simulated rain over set time intervals and the results of these tests have been plotted in FIGS. 2 and 3.

As shown in FIG. 2, the power level from a conventionally mounted planar array antenna is significantly different under dry conditions as represented by the solid line and wet conditions as represented by the dash line. Under wet conditions the antenna performed very poorly.

FIG. 3 clearly demonstrates the effect of mounting the antenna in accordance with the present invention on the operation of the antenna. With the antenna so mounted the power under dry (solid line) conditions or under wet (dash line) conditions showed essentially the same performance i.e. the wet (dash line) conditions did not significantly change the performance of the antenna.

The planar array antennas suitable for use with the present invention include those above described, namely:

1. resonant and non-resonant slotted rays
2. micro-strip antennas
3. dielectric resonator antennas.

These antennas may be used for horizontal, vertical or circular polarization, satellite and terrestrial applications and for transmitting and or receiving.

Having described the invention, modifications will be evident to those skilled in the art without departing from the scope of the invention as defined in the appended claims.

We claim:

1. A method of inhibiting rain from wetting a radiating face of a planar array antenna for millimeter wave length communication systems, said planar array antenna for said millimeter wave length communication system being selected from the group consisting of planar array antenna constructed to operate at either at single frequency or at a pair of different frequencies comprising mounting said planar array antenna with its radiating face at an angle $\alpha$ to the horizontal of between 20 and 70° and with its radiating face facing downwards toward earth so that it is shielded from rain and rain cannot fall directly onto said radiating face, selecting a radiating angle $\theta$ for a main beam of said planar array antenna coordinated with said angle $\alpha$ to the horizontal to focus said main beam in a selected direction at an elevation angle $\omega$ to earth so that said radiating face of said antenna radiates upward away from earth and toward a selected target.

2. A method of reducing the effect of rain wetting a radiating face of a planar array antenna for millimeter wave length communication systems as defined in claim 1 wherein said planar array antenna is a slotted array antenna.

* * * * *